US006318422B2

(12) United States Patent
Woratyla et al.

(10) Patent No.: US 6,318,422 B2
(45) Date of Patent: Nov. 20, 2001

(54) FUNNEL FOR VISCOUS LIQUIDS

(76) Inventors: Robert N. Woratyla, 1720 Sweet Arrow Lake Rd., Pottsville, PA (US) 17901; Joseph B. Soisson, 64 Dwight St., West Lawn, PA (US) 19609

( * ) Notice: Subject to any disclaimer, the term of this patent is extended or adjusted under 35 U.S.C. 154(b) by 0 days.

(21) Appl. No.: 09/796,369

(22) Filed: Mar. 2, 2001

Related U.S. Application Data

(60) Provisional application No. 60/186,754, filed on Mar. 3, 2000.

(51) Int. Cl.[7] ..... B65B 39/00; B67C 11/04

(52) U.S. Cl. ..... 141/333; 141/331; 141/339; 141/342

(58) Field of Search ..... 141/108, 331–345; D7/700

(56) References Cited

U.S. PATENT DOCUMENTS

| | | | | |
|---|---|---|---|---|
| D. 59,648 | | 11/1921 | Gregory . | |
| D. 363,221 | | 10/1995 | Puryear . | |
| D. 374,281 | | 10/1996 | Markles . | |
| D. 375,878 | | 11/1996 | Morris . | |
| D. 394,989 | | 6/1998 | Block . | |
| D. 402,169 | | 12/1998 | Hestehave et al. . | |
| 865,572 | | 9/1907 | Dawson . | |
| 1,487,824 | | 3/1924 | Vincent . | |
| 4,347,878 | * | 9/1982 | Schofield | 141/300 |
| 4,571,191 | | 2/1986 | Graube . | |
| 5,195,567 | * | 3/1993 | Tyree, Jr. | 141/331 |

FOREIGN PATENT DOCUMENTS

| | | |
|---|---|---|
| 18302 | 8/1896 | (GB) . |
| 93186 | 11/1938 | (SE) . |

* cited by examiner

*Primary Examiner*—Timothy L. Maust
(74) *Attorney, Agent, or Firm*—Richard C. Litman

(57) ABSTRACT

A funnel structure with different cross-sectional shaped bowl and spout for transferring viscous food materials from one vessel to another, to eliminate the problem of entrapped air causing splashing. The funnel has a circular bowl and a spout with a square cross-section which can be offset from the circular bowl.

2 Claims, 2 Drawing Sheets

FUNNEL FOR VISCOUS LIQUIDS

CROSS-REFERENCE TO RELATED APPLICATION

This application claims the benefit of U.S. Provisional Patent Application Ser. No. 60/186,754, filed Mar. 3, 2000.

BACKGROUND OF THE INVENTION

1. Field of the Invention

The present invention relates to a funnel for transferring viscous liquids, without entrapment and escaping upward of trapped air, having a bowl and a spout with different cross-sectional shapes, and alternatively, an offset spout.

2. Description of related Art

The relevant art of interest describes various funnels, but none discloses the present invention. There is a need for a funnel having a circular bowl and a spout with a square cross-section for transferring viscous liquids, such as food, without the entrapment and escaping upward of trapped air. An alternative embodiment has an offset spout portion. The relevant art will be discussed in the order of perceived relevance to the present invention.

U.S. Design Pat. No. 402,169 issued on Dec. 8, 1998, to Borge T. Hestehave et al. describes a square funnel with rounded corners. The square funnel is distinguishable for its regular square configuration for both the upper opening and the spout.

Gt. Britain Patent Application No. 18,302 published on Aug. 18, 1896, for Beesley describes a square funnel with sharp corners. The square funnel is distinguishable for its uniformly sharp cornered receptacle and sharp cornered spout.

Sweden Patent Application No. 93,186 published on Nov. 5, 1938, for N. A. Nylen shows a round or corrugated funnel with an apertured bottom, a circular outlet and either an outside square, triangular or circular fence at a mediate location to seat on a bottle neck. In the necked portion, a liquid level structure is included. The funnel is distinguishable for its fencing and the liquid level structure.

U.S. Pat. No. 4,571,191 issued on Feb. 18, 1986, to Peeris E. Graube describes a funnel teaching method and apparatus, wherein a ring on a stand above a collecting beaker has four hooks for suspending a funnel. The funnel can have either a rectangular receptacle and a rectangular spout with an off-centered aperture (FIGS. 2 and 3), an irregularly shaped spout (FIGS. 6–8), or a circular shaped funnel with a necked region. The various funnels are distinguishable for their non-symmetrical structures.

U.S. Pat. No. 865,572 issued on Sep. 10, 1907, to Wallace Dawson describes a funnel with a conical bowl having grooves radiating downward and external grooves on its neck. The funnel is distinguishable for its conventional form and grooved regions.

U.S. Design Pat. No. 59,648 issued on Nov. 15, 1921, to George Gregory describes a two-piece funnel having three indented faces in the bowl portion fitting into a lower conventionally shaped funnel and having a triangularly shaped spout. The funnel is distinguishable for its two-piece and triangular spout structure.

U.S. Design Pat. No. 363,221 issued on Oct. 17, 1995, to Larry A. Puryear describes a combined cap and funnel for use with automobile liquids comprising a rectangular cross-section with a planar tabbed bottom plate. The funnel is distinguishable for its uniformly rectangular cross-section and the required tabbed cap.

U.S. Design Pat. No. 374,281 issued on Oct. 1, 1996, to Elmer C. Markles describes a female urinal funnel having a rectangular cross-section with spout opening skewed to one side. The funnel is distinguishable for its uniformly rectangular cross-section.

U.S. Design Pat. No. 375,878 issued on Nov. 26, 1996, to Michael A. Morris describes a tabbed funnel with a circular bowl and a circular neck with linear grooves on the inside and outside. The funnel is distinguishable for its grooved neck.

U.S. Design Pat. No. 394,989 issued on Jun. 9, 1998, to Robert H. Block describes a funnel with collapsible sides and folding lid. The cross-sectional shape can be circular, square, pentagonal, or hexagonal. The funnel is distinguishable for its lid and collapsible structure.

U.S. Pat. No. 1,487,824 issued on Mar. 25, 1924, to Charles W. Vincent describes a circular funnel with a flanged collar and a grooved neck. The funnel is distinguishable for its collar and grooved neck.

None of the above inventions and patents, taken either singly or in combination, is seen to describe the instant invention as claimed.

SUMMARY OF THE INVENTION

The invention is made up of a funnel structure having a circular cross-section and a spout with a square cross-section for transferring viscous food materials from one vessel to another, to eliminate the problem of entrapped air causing splashing.

Accordingly, it is a principal object of the invention to provide a funnel for transferring viscous materials.

It is another object of the invention to provide a funnel for transferring viscous foods.

It is a further object of the invention to provide a funnel having a bowl with a circular cross-section and a spout with a square cross-section.

Still another object of the invention is to provide a funnel having a bowl with a circular cross-section and a skewed spout with a square cross-section.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to funnels for transferring viscous food and the like materials from one vessel to another.

Figure 1:
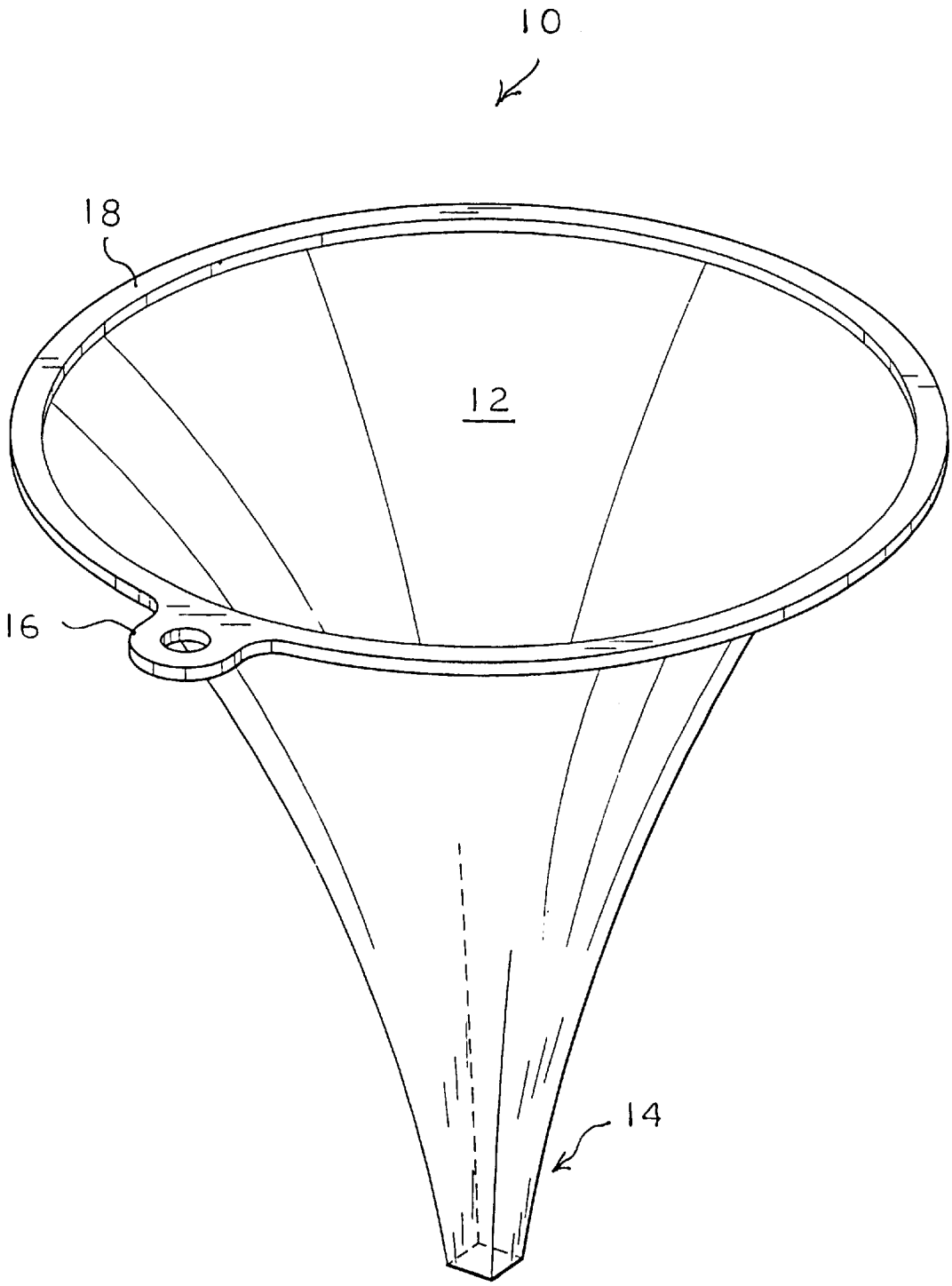
FIG. 1 is a perspective view of a first embodiment of a funnel for transferring viscous liquids according to the present invention.

FIG. 1 illustrates the first embodiment of a funnel 10 having a bowl portion 12 with a circular cross-section and a spout portion 14 with a square cross-section. The enlarging square cross-section gradually merges with the enlarging circular cross-section of the funnel 10. An apertured tab 16 is provided on the flanged rim 18 of the bowl portion 12 for convenience in holding and hanging the funnel 10. This contrasting cross-sectional configuration of a circular bowl portion and a spout portion with a square cross-section solves the often encountered problem of entraining air as the viscous food in the bowl portion whirlpools into the spout portion entrapping air in the process, whereupon the entrapped air, in bubble form, rises to the surface in the funnel and in the collecting viscous liquid to cause deleterious spattering of the liquid.

Figure 2:
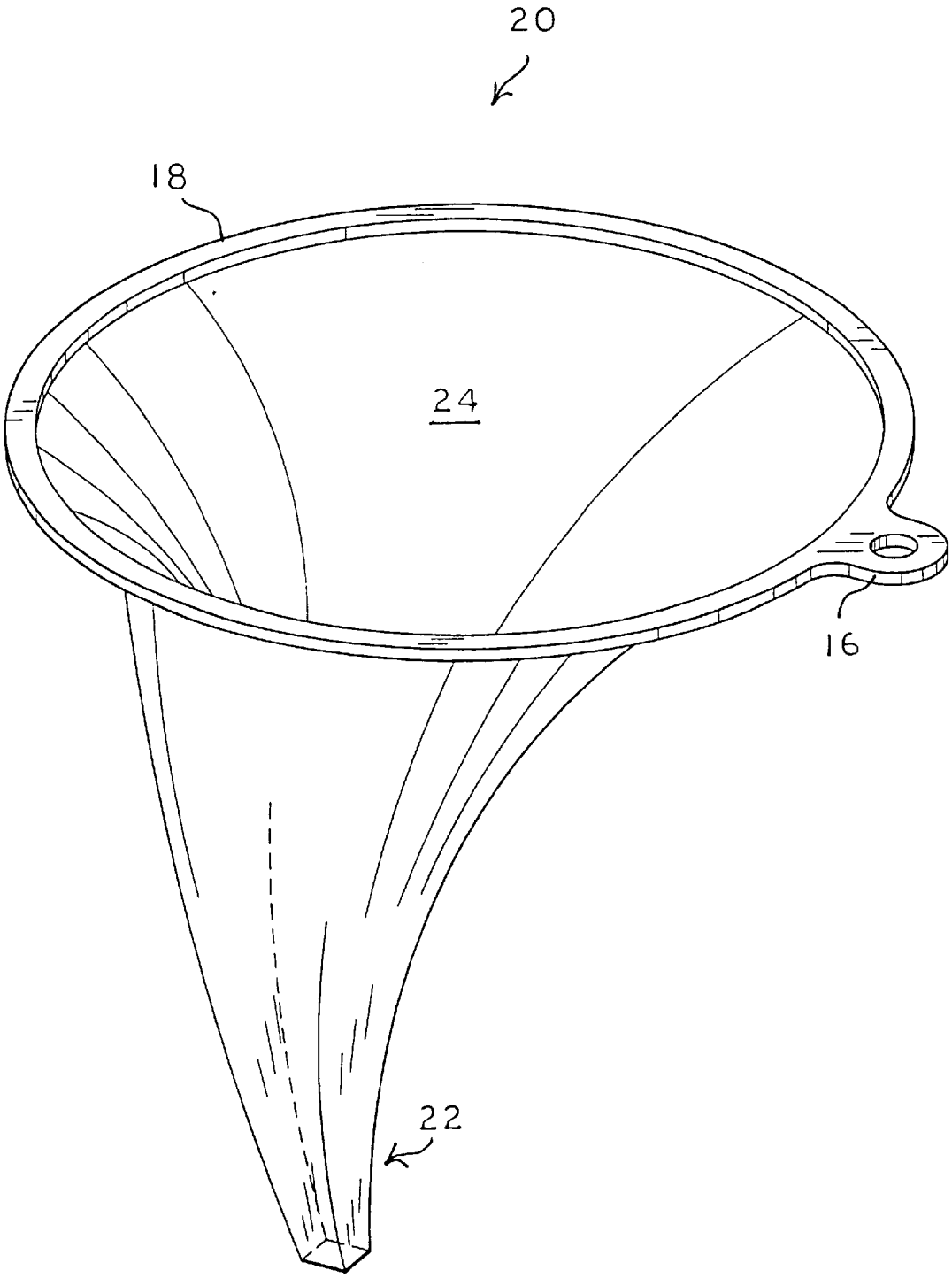
FIG. 2 is a perspective view of a second embodiment of a funnel for transferring viscous liquids according to the present invention.

FIG. 2 illustrates a second embodiment of a funnel 20 wherein the spout portion 22 is skewed from the bowl portion 24 preferably opposite from the tab 16. This unique skewing of the spout portion apparently further limits the entrapment of air since the whirlpool is also skewed to one side of the bowl portion 24.

It is to be understood that the present invention is not limited to the sole embodiments described above, but encompasses any and all embodiments within the scope of the following claims.

We claim:

1. A funnel for transferring viscous liquid materials from one container to another container, said funnel comprising:

a circular bowl portion having an apertured tab extending therefrom; and a spout portion having an opening with a square cross-section and gradually and smoothly merging with the circular bowl section, wherein the spout portion is skewed to one side toward the apertured tab;

whereby viscous liquid materials can be transferred without entrapment of air and resultant spattering of the escaping air.

2. The funnel according to claim 1, further comprising a flanged rim around the circular bowl portion.

* * * * *